US005308035A

United States Patent [19]

Ross

[11] Patent Number: 5,308,035

[45] Date of Patent: May 3, 1994

[54] ADJUSTABLE ARTIST'S EASEL

[75] Inventor: Robert N. Ross, Orlando, Fla.

[73] Assignee: Bob Ross Incorporated, Chantilly, Va.

[21] Appl. No.: 887,757

[22] Filed: May 27, 1992

[51] Int. Cl.[5] ..... A47G 1/24

[52] U.S. Cl. ..... 248/454; 248/460

[58] Field of Search ..... 248/454, 447, 449, 450, 248/455, 460, 463, 464, 465; 40/610

[56] References Cited

U.S. PATENT DOCUMENTS

| | | | |
|---|---|---|---|
| 1,951,960 | 3/1934 | Anduaga . | |
| 2,568,354 | 9/1951 | Moore . | |
| 2,844,896 | 7/1958 | Kuruc . | |
| 3,095,665 | 7/1963 | Killen . | |
| 3,095,666 | 7/1963 | Killen . | |
| 3,095,834 | 7/1963 | Killen . | |
| 3,195,849 | 7/1965 | Maddox . | |
| 3,368,786 | 2/1968 | Bulman . | |
| 3,416,764 | 12/1968 | Bier . | |
| 3,467,259 | 9/1969 | Silver | 248/460 X |
| 3,623,691 | 11/1971 | Albee . | |
| 3,809,354 | 5/1974 | Phifer . | |
| 3,926,398 | 12/1975 | Vincent . | |
| 4,109,892 | 8/1978 | Hartung . | |
| 4,134,614 | 1/1979 | Fielding, Sr. . | |
| 4,165,856 | 8/1979 | Wiseheart . | |
| 4,270,462 | 6/1981 | Driscoll . | |
| 4,482,185 | 11/1984 | Zoellner . | |
| 4,546,948 | 10/1985 | Ferrara . | |
| 4,690,363 | 9/1987 | Koves . | |
| 4,717,109 | 1/1988 | Johnston . | |
| 4,824,064 | 4/1989 | Oncale . | |
| 4,877,213 | 10/1989 | Lambert . | |
| 5,005,795 | 4/1991 | Holmgren . | |
| 5,074,513 | 12/1991 | Presley et al. . | |

FOREIGN PATENT DOCUMENTS

| | | | |
|---|---|---|---|
| 619120 | 3/1949 | United Kingdom | 248/454 |

*Primary Examiner*—Blair M. Johnson
*Attorney, Agent, or Firm*—Larson and Taylor

[57] ABSTRACT

An adjustable and adaptable artist's easel for holding a canvas includes an upper stand. The upper stand includes a planar frame having opposed sides, a front, a back, a top, and a bottom. This upper stand also includes a canvas support on the front of the frame, a top clamp, and a clamp adjusting device for adjustably mounting the top clamp on the front of the frame for movement toward and away from the canvas support and for locking the top clamp in an adjusted position relative to the canvas support with the canvas clamped therebetween and on the front. This upper stand further includes a pair back legs having a free end, a back leg pivot for pivotally mounting the back legs to the frame, and a back leg locking device for adjustably locking the back legs with the free ends spaced from the planar frame such that the upper stand is capable of standing in an upright position and hence for being used on a table top or the like. The easel also includes a free standing lower base and an attaching mechanism for removably attaching the upper stand to the lower base such that the upper stand is mounted above the lower base. The easel is then usable by itself as a free standing easel, and in this configuration, the frame is tiltable downwards for convenience.

31 Claims, 6 Drawing Sheets

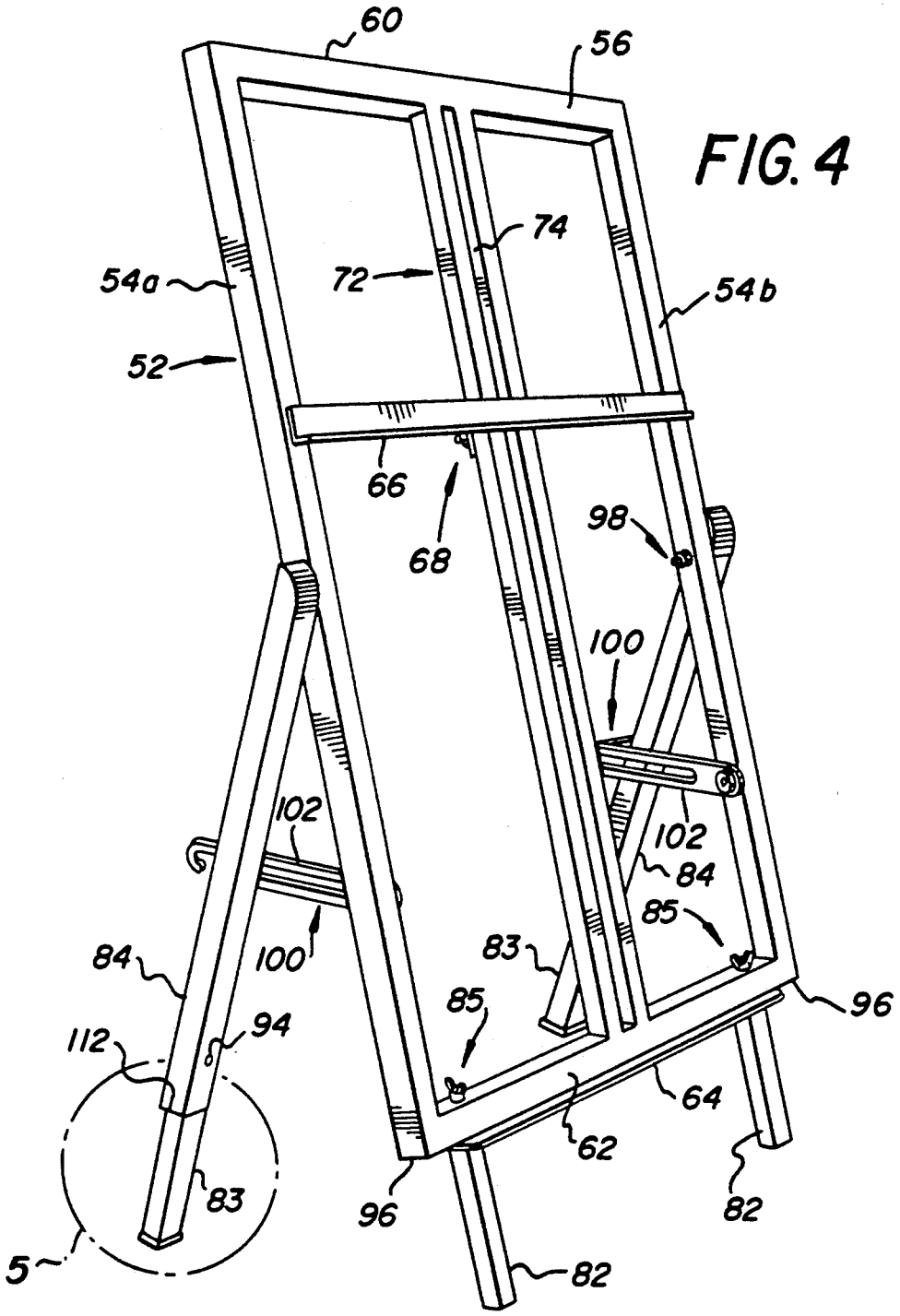
FIG. 4
FIG. 5
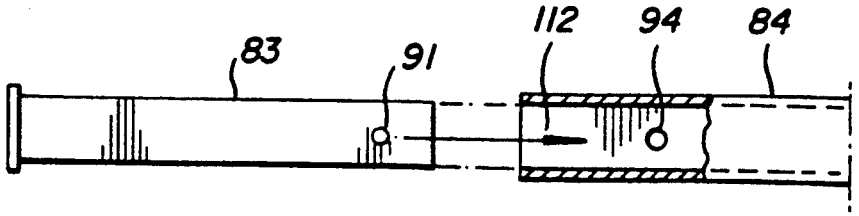

60
58
74
52
72
54a
54b
68
12
76
66
78
84
98
84
104
100
100
102
97
83
102
104
96
97
88
82
112
42
94
96
86
18
62
90
114
112
40
10
14
28b
16b
16a

FIG. 10
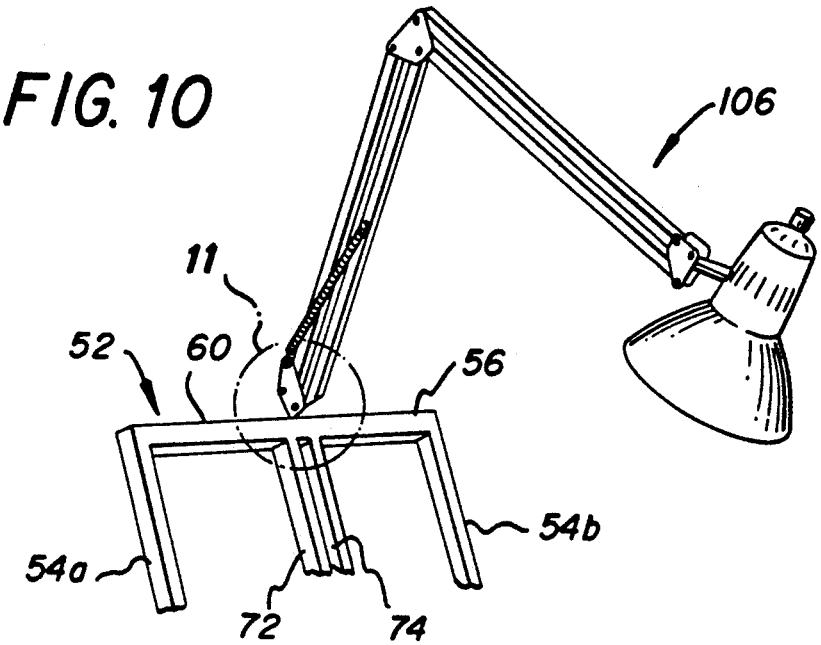
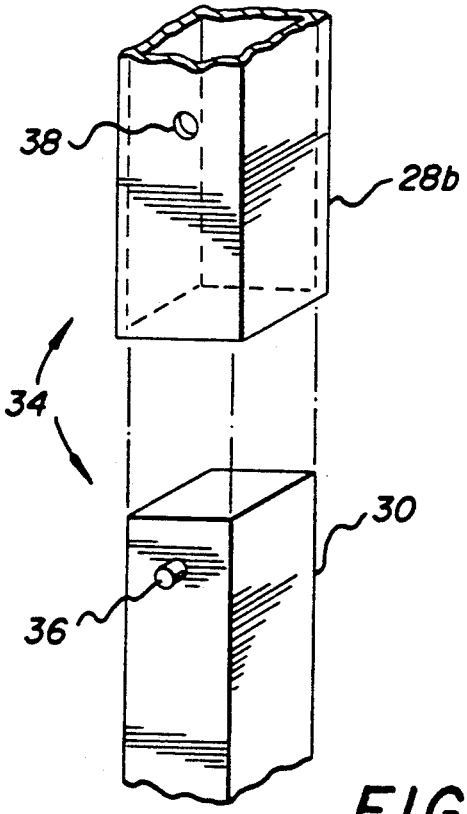
FIG. 9
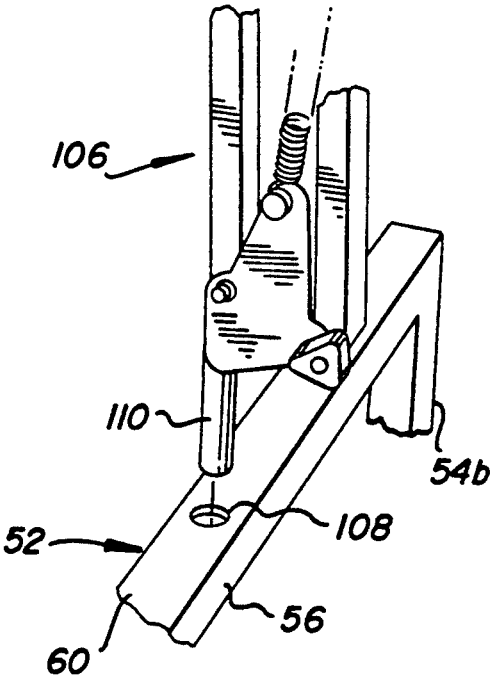
FIG. 11

ADJUSTABLE ARTIST'S EASEL

FIELD OF THE INVENTION

The present invention relates generally to an artist's easel, and more particularly to an artist's easel which is usable on a table top or the like as well as on an associated free standing lower base with the frame for the canvas tilted away from vertical.

BACKGROUND OF THE INVENTION

Numerous artist's easels have been disclosed in the prior art with various adjustments thereof. Examples of such prior art easels are shown in various U.S. Patents. For example, in U.S. Pat. No. 5,074,513 (Presley et al.), an easel with a tilting means for a canvas is provided. In U.S. Pat. No. 4,690,363 (Koves) there is also disclosed a canvas carrier with a tripod which permits an angular adjustment of the canvas. A table top easel with an adjusting means for the angle of the workpiece relative to the table surface is further disclosed in U.S. Pat. No. 4,270,462 (Driscoll). Another patent of general interest disclosing a combination adjustable chair and easel where the easel is swingable is disclosed in U.S. Pat. No. 1,951,960 (Anduaga).

While there are numerous prior art easels including those mentioned above which are variably adjustable, there still exists a need for an easel which is usable both on a table and free standing, and which is capable of tilting the canvas downward toward the artist.

SUMMARY OF THE INVENTION

In accordance with the present invention, a uniquely adjustable and adaptable artist's easel is provided for holding a canvas. The easel comprises an upper stand including a canvas holding means and a standing means for holding a remainder of the upper stand in an upright position. The upper stand preferably includes a planar frame having opposed sides, a front, a back, a top, and a bottom. The canvas holding means of the upper stand includes a canvas support on the front of the frame, a top clamp, and a clamp adjusting means for adjustably mounting the top clamp on the front of the frame for movement toward and away from the canvas support and for locking the top clamp in an adjusted position relative to the canvas support with the canvas clamped therebetween and on the front. The standing means of the upper stand preferably includes at least one back leg having a free end, a back leg pivot means for pivotally mounting the at least one back leg to the frame, and a back leg locking means for adjustably locking the at least one back leg with the free end spaced from the planar frame such that the upper stand is capable of standing in an upright position and hence for being used on a table top or the like.

The easel of the present invention also includes a free standing lower base and an attaching means for removably attaching the upper stand to the lower base such that the upper stand is mounted above the lower base. The easel is then usable by itself as a free standing easel.

In a preferred embodiment, the lower base includes at least three base legs with each base leg having a foot. A base leg mounting means then pivotally mounts the base legs to one another such that the base legs are movable between a collapsed position where the base legs are nearly coplanar and a supporting position where the feet of the base legs are spread apart and the lower base is supported in a standing position. Most preferably, there are four of the base legs which are attached together in pairs, and the base leg mounting means mounts one pair of the base legs to the other the pair of base legs. In addition, a brace means is also provided for holding the pairs of base legs in a position with the feet spaced from one another. With this configuration, the lower base also preferably includes a mounting bracket on each base leg and a shelf which is supported on the mounting brackets between the base legs.

In the preferred embodiment, each base leg also includes an upper bar, an extension including the foot at one end and whose other end is telescopically received in the upper bar, and an adjustment means for locking the other end of the extension to the associated upper bar at a plurality of positions.

The frame is preferably rectangular and includes parallel sides. The upper stand then includes two of the back legs with each back leg being pivotally attached to a respective side of the frame by a respective back leg pivot means. In addition, the upper stand includes two front legs attached to the bottom of the frame, and the sides of the frame are parallel and include respective hollow ends. The back legs include respective removable extensions which are used to support the upper stand in the upright position together with the front legs, and these back legs are received in the hollow ends of the parallel sides when the upper stand is attached to the lower base. Further, the bottom of the frame preferably includes spaced bottom apertures, and thus the two front legs each include a front leg coupling means for removably attaching the front leg to a respective bottom aperture.

The attaching means for attaching the upper stand to the lower base preferably includes studs provided on a pair of the base legs of the lower base and respective sockets provided in the free ends of the back legs in which an associated stud is received. In addition, in the preferred embodiment, locking apertures are provided in the studs and the sockets which align when the studs are received in the associated sockets. Then the front leg coupling means is received in the locking apertures when the upper stand is mounted to the lower base to lock the upper stand to the lower base. The attaching means most preferably attaches the upper stand to the lower base with the back legs extending at an angle to vertical so that the back leg pivot means pivotally attaches the back legs to the frame for movement of the frame between positions on each side of vertical when the upper stand is attached to the lower base.

In the preferred embodiment, the top of the frame includes a mounting aperture in which a light fixture having a mounting rod is removably received. In addition, the clamp adjusting means includes a central bar extending in-between the parallel sides and a means for adjustably locking the top clamp to the central bar.

It is an advantage of the present invention that an easel is provided which can be used both on a table top or on any lower height surface such as the ground.

It is also an advantage of the present invention that in the free standing configuration the bottom of the frame for the canvas can be tilted to either side of vertical as desired.

It is another advantage of the present invention that a mounting means for a shelf and for a light is provided.

Still another advantage of the present invention is that almost any size canvas can be mounted to the frame provided.

Other features and advantages of the present invention are stated in or apparent from a detailed description of a presently preferred embodiment of the invention found hereinbelow.

BRIEF DESCRIPTION OF THE DRAWINGS

FIG. 4 is a left and front elevational perspective view of the upper stand depicted in FIG. 1 in a table top standing configuration.

FIG. 5 is an elevational view of the elements depicted in FIG. 4 surrounded by the broken line 5.

FIG. 9 is an elevational perspective view of the attachment of an extension to a base leg of the lower base.

FIG. 10 is a front elevational perspective view of the top portion of the upper stand with a light fixture attached thereto.

FIG. 11 is a top plan perspective view of the elements surrounded by the broken line 11 in FIG. 10 and showing the attachment of the light fixture to the top of the upper stand.

DETAILED DESCRIPTION OF THE PREFERRED EMBODIMENT

Figure 1:
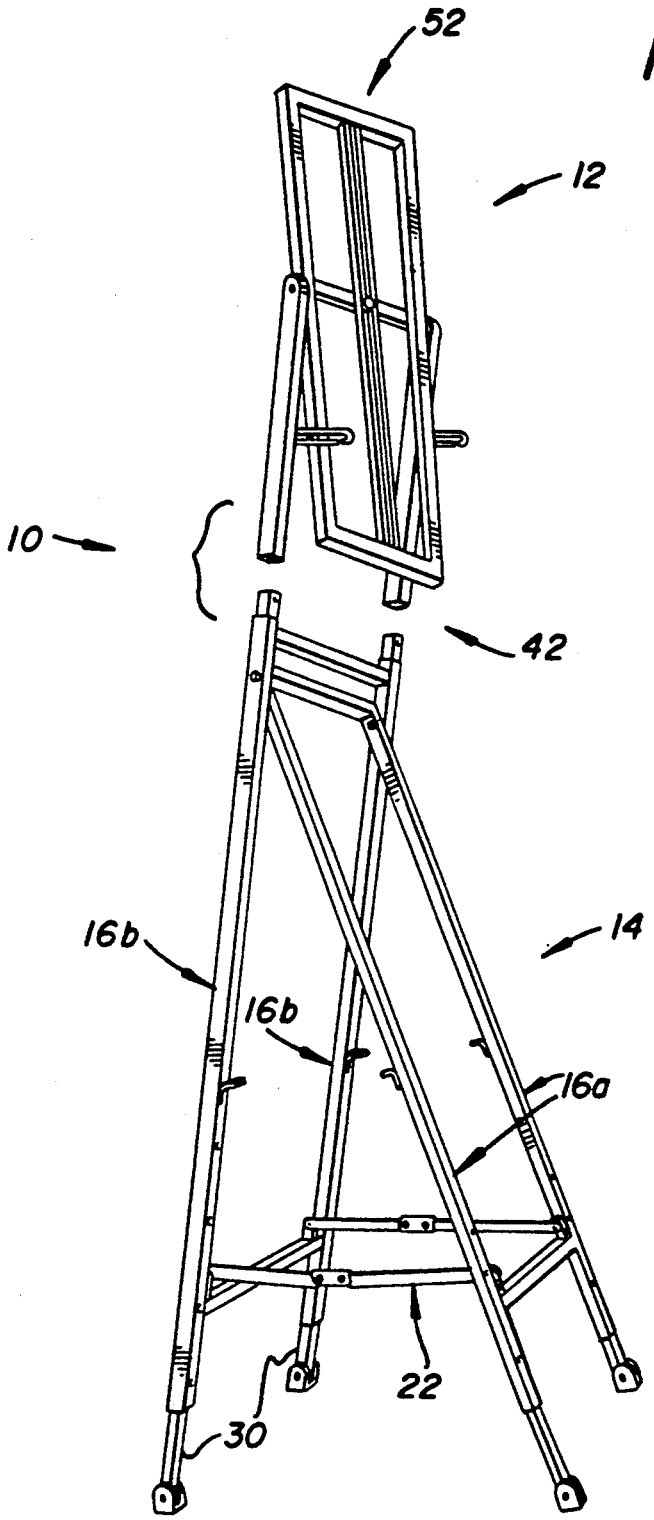
FIG. 1 is a right side elevational perspective view of the upper stand posed to be connected to lower base to form a free standing configuration of the artist's easel according to the present invention.
Figure 2:
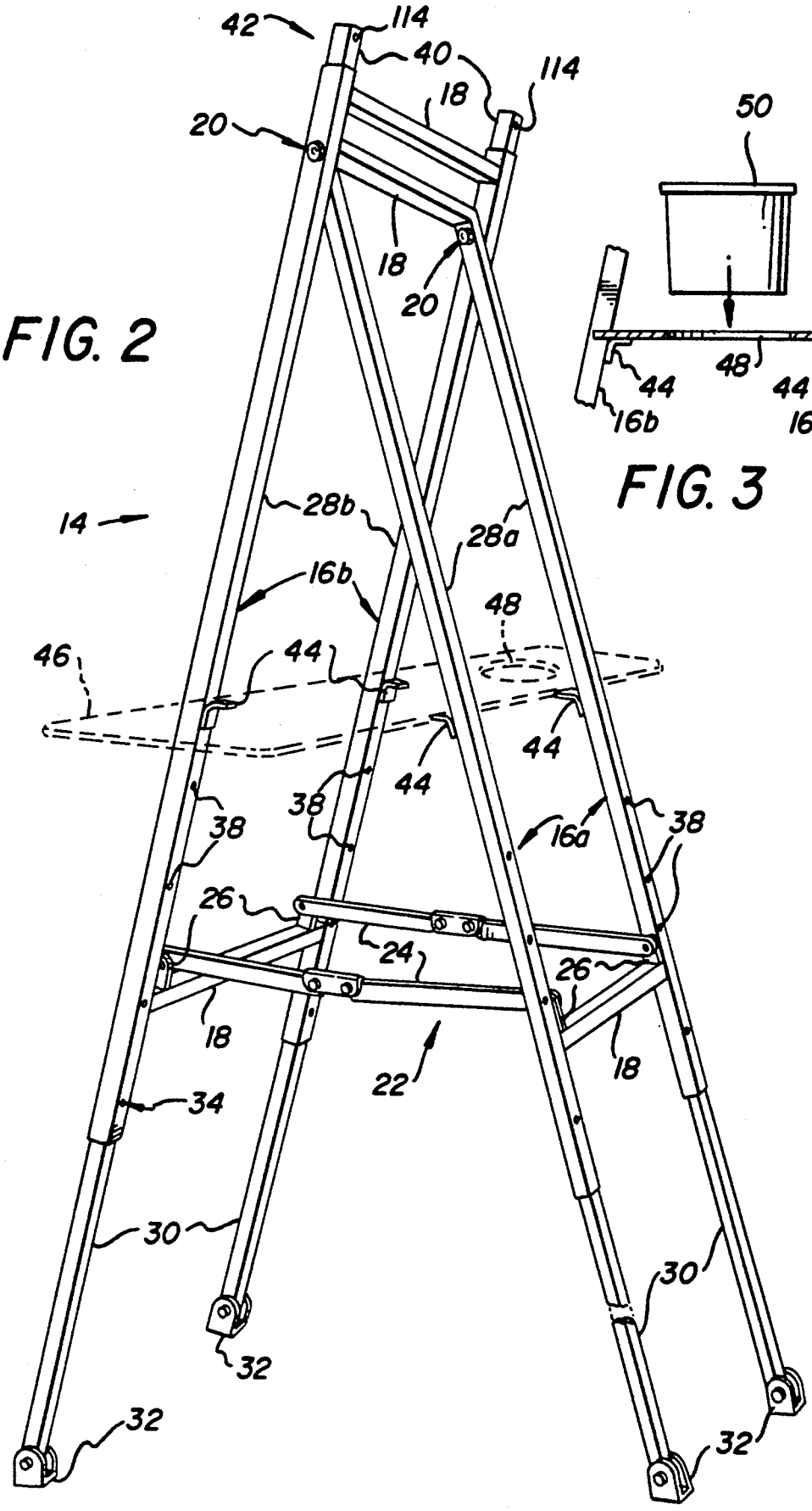
FIG. 2 is a right side elevational perspective view showing the lower stand of FIG. 1 in greater detail.

With reference now to the drawings in which like numerals represent like elements throughout the drawings, an artist's easel 10 according to the present invention is depicted in FIG. 1 with an upper stand 12 in position to be attached to a lower base 14. As shown in greater detail in FIG. 2, lower base 14 is formed of two pairs of base legs 16*a* and 16*b*, which pairs are held together by suitable cross pieces 18. Lower base 14 is free standing and is made collapsible by attaching adjacent base legs 16*a* and 16*b* together using a base leg mounting means 20 so that base legs 16*a* and 16*b* can be made nearly coplanar. Suitably, base leg mounting means 20 is simply a nut and bolt as shown which pass through apertures provided in base legs 16*a* and 16*b*. In order to hold base legs 16*a* and 16*b* at a desired spaced position, a brace means 22 is provided. Brace means 22 is suitably a pair of foldable braces 24, with each brace 24 positioned between opposed base legs 16*a* and 16*b* and pivotally attached by brackets 26 to cross pieces 18.

Each base leg 16*a* and 16*b* is formed of a respective upper bar 28*a* or 28*b* and an extension 30. At one end, extension 30 has a pivotable foot 32 in order to evenly engage a supporting surface. The other end of extension 30 is telescopically received in the associated end of upper bar 28*a* or 28*b*. In order to hold extension 30 at various adjusted telescopic positions in upper bar 28*a* or 28*b*, an adjustment means 34 is provided As shown best in FIG. 9, adjustment means 34 includes a spring mounted button 36 provided on the upper end of extension 30 and a series of receiving apertures 38 provided along the length of upper bar 28. With adjustment means 34, it will be appreciated that the overall height of lower stand 14 is easily adjustable by simply pushing button 36 inward and moving the associated extension telescopically as desired. In FIG. 1, it will be appreciated that lower stand 14 is shorter than lower stand 14 in FIG. 2, as a longer length of extensions 30 extend from upper bars 32 in FIG. 2.

Figure 3:
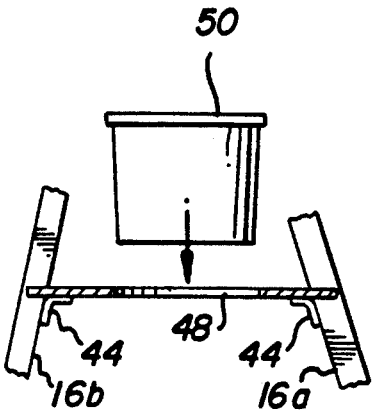
FIG. 3 is left side cross-sectional view of the shelf provided on the lower base depicted in phantom in FIG. 2.

At the upper ends of base legs 16*b*, a stud 40 is provided. As discussed subsequently, studs 40 are part of an attaching means 42 which is used to mount upper stand 12 to lower base 14. Also provided at intermediate positions along base legs 16*a* and 16*b* are mounting angle brackets 44 on which a shelf 46 is easily placed and located by suitable cutouts in which base legs 16*a* and 16*b* are received. As shown in FIG. 3, shelf 46 preferably includes a hole 48 therein in which a bucket 50 is received and held in place by the rim thereof.

Depicted in FIG. 4 is upper stand 12 configured to stand alone (without lower base 14) for use on a table top or other raised surface. Upper stand 12 includes a planar rectangular frame 52 having opposed sides 54*a* and 54*b*, a front 56, a back 58, a top 60, and a bottom 62. Mounted on bottom 62 is a canvas support 64 which extends beyond front 56 as shown. Associated with canvas support 64 is a top clamp 66 and a clamp adjusting means 68. Clamp adjusting means 68 is used for adjustably mounting top clamp 66 on front 56 of planar frame 52 for movement toward and away from canvas support 64 and for locking top clamp 66 in an adjusted position relative to canvas support 64 with a canvas 70 clamped therebetween and on front 56 of planar frame 52.

Figure 7:
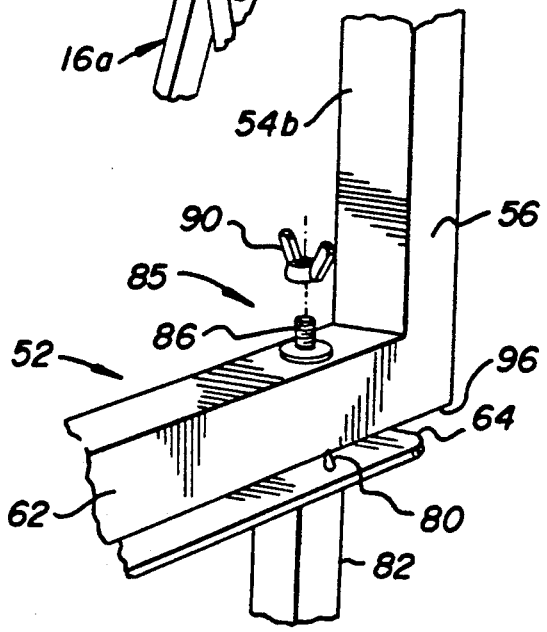
FIG. 7 is a front elevational perspective view of the attachment of a front leg to the upper stand.

In this preferred embodiment, clamp adjusting means 68 includes a central bar 72 extending vertically in-between sides 54*a* and 54*b*. Central bar 72 includes a central longitudinal slot 74, and extending perpendicular to the plane of frame 52 through slot 74 is a threaded bolt 76 secured to top clamp 66. Received on bolt 76 is a knurled knob 78 which is used as a means for locking top clamp 66 to central bar 72. With this design, knob 78 is tightened about bolt 76 to engage top clamp 66 in place or loosened to allow bolt 76 to slide up and down in slot 74 and thus to adjust the position of top clamp 66 relative to canvas support 64 as desired. In use, with top clamp 66 free to move, canvas 70 is simply rested on canvas support 64 and against front 56. Then, top clamp 66 is moved down into engagement with canvas 70 and locked in place by tightening knob 78 to thus hold canvas 70 in place. As shown in FIG. 7, a number (such as three) small spikes 80 (only one of which is shown) can be provided along canvas support 64 and top clamp 66 to help hold canvas 70 in place.

In the configuration depicted in FIG. 4, upper stand 12 is provided with removable front legs 82 and removable extensions 83 for back legs 84 on which upper stand 12 rests. However, it will be appreciated that if it is desired to lower the height of upper stand 12, front legs 82 and extensions 83 can be removed (and are removed when upper stand 12 is attached to lower base 14 as discussed subsequently). As shown best in FIG. 7, each front leg 82 is attached to bottom 62 of frame 52 by use of a front leg coupling means 85 for holding front leg 82 in place securely and removably. Front leg coupling means includes a bolt 86 extending upwardly from front leg 82, an aperture 88 in bottom 62 through which bolt 86 extends, and a nut 90 received on bolt 86.

Figure 8:
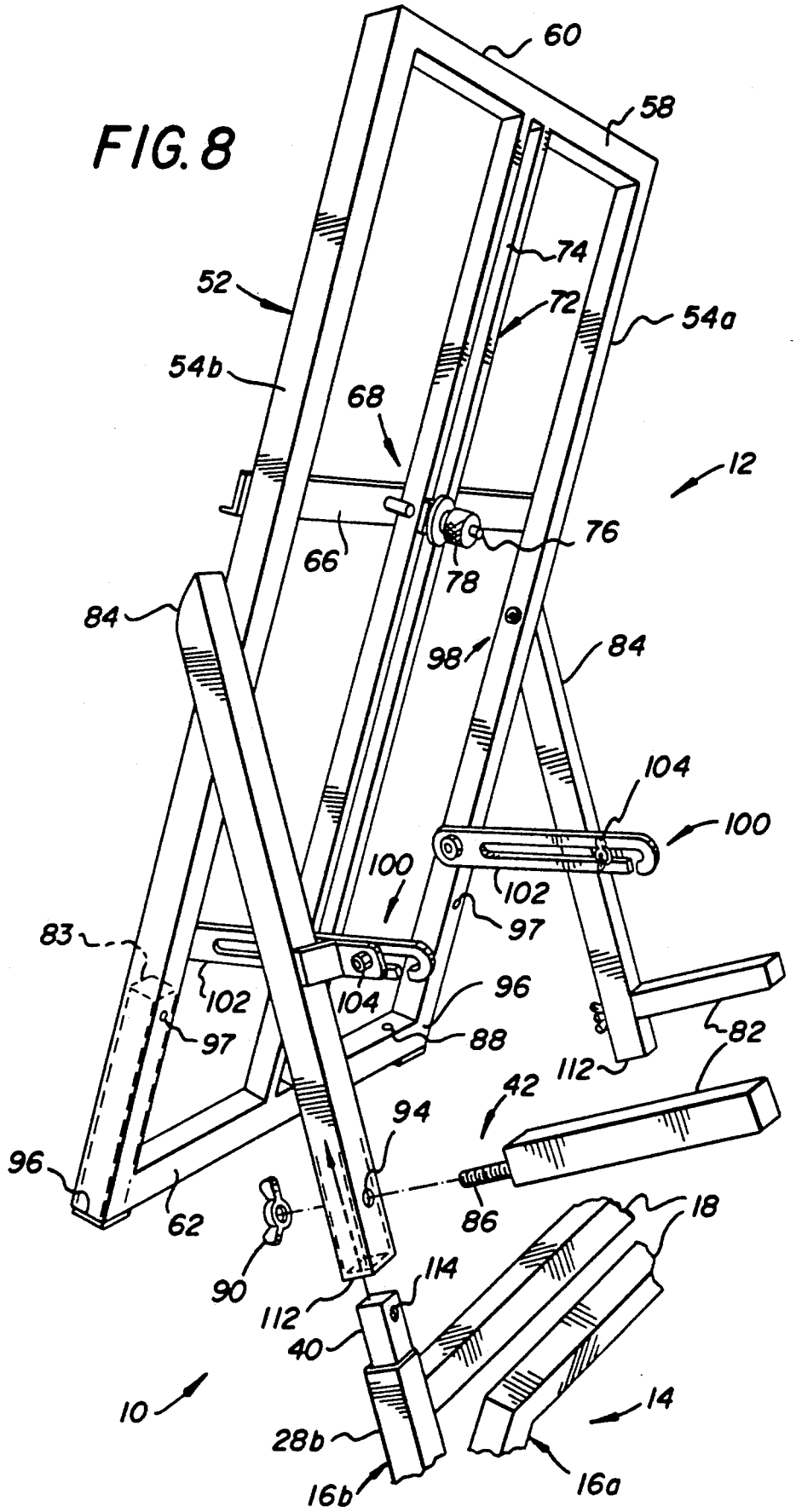
FIG. 8 is right side and rear elevational perspective view of the attachment of the upper stand to the lower base.

Each extension 83 for the associated back leg 84 is made removable from a free end thereof forming a socket 112 by a spring mounted button 92 and an associated aperture 94 in back leg 84 (in the same manner as adjusting means 34 discussed above). In addition, it will also be appreciated that when extensions 83 are removed from sockets 112 of back legs 84, extensions 83 are stored in hollow ends 96 of sides 54*a* and 54*b* as shown in FIG. 8. In order to removably hold each extension 83 in hollow end 96 of the associated side 54*a* or 54*b*, each side 54*a* or 54*b* is also provided with an aperture 97.

With particular reference to FIGS. 4 and 8, it will be appreciated that back legs 84 are pivotally attached to a respective side 54*a* or 54*b* at one end by a back leg pivot means 98. Back leg pivot means 98 is preferably simply a nut and bolt as shown. Also associated with each back leg 84 is a back leg locking means 100 for adjustably locking the associated back leg 84 in a desired pivoted position with the free end of the back leg spaced from frame 52 so that upper stand will stand in an upright position together with front legs 82. Preferably, back leg locking means 84 includes a slotted brace 102 pivotally attached to an associated side 54*a* or 54*b* and a wing nut assembly 104 attached to an associated back leg 84. It will be appreciated that back leg locking means 100 operates in the same manner as top clamp adjusting means 68 to lock the associated back leg 84 at any desired pivotal position within the range of the slot in slotted brace 102. And, it will also be appreciated that the range provided by back leg locking means 100 allows frame 52 to pivot on each side of vertical as shown in phantom lines in FIG. 6.

In case it is desired to mount a light fixture 106 to easel 10, frame 52 is provided with a mounting aperture 108 in top 60 as shown in FIG. 11. Thus, a mounting rod 110 of light fixture 106 is easily received in mounting aperture to mount light fixture 106.

Figure 6:
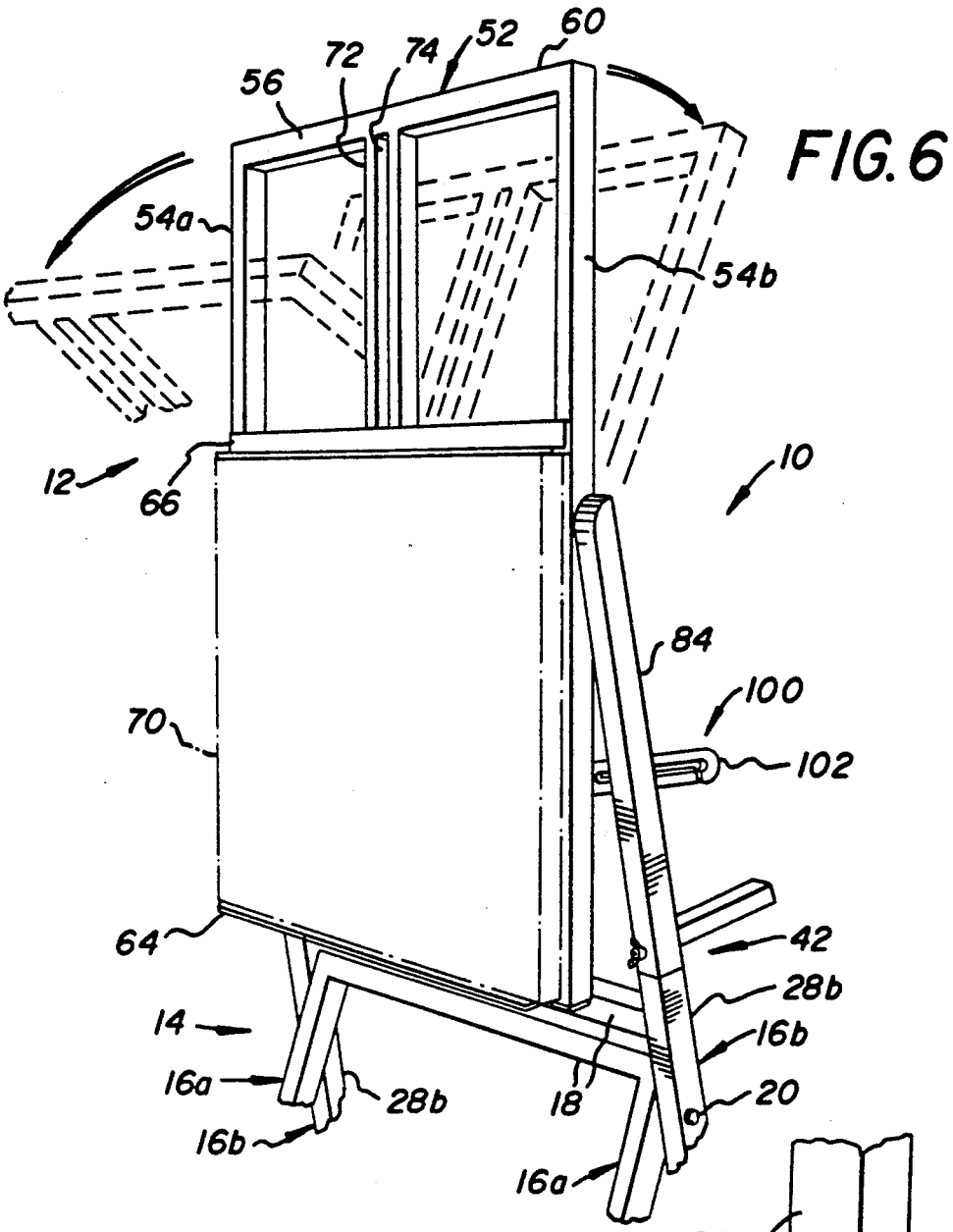
FIG. 6 is a front and right side elevational perspective view showing the adjustability of the frame when the upper stand is attached to the lower base.

As mentioned above, attaching means 42 includes studs 42 located at the upper ends of base legs 16*b*. Attaching means 40 also includes sockets 112 found in the free ends of back legs 84. Thus, it will be appreciated that upper stand 12 is attached to lower base 14 simply by inserting studs 40 in associated sockets 112 as shown in FIGS. 1 and 8. In order to assure that upper stand 12 is securely attached to lower base 14, attaching means 42 also includes apertures 114 provided in studs 40 which align with apertures 94 in back legs 84. Then, as shown in FIGS. 6 and 8, front legs 82 also serve as part of attaching means 42 as bolts 86 of front legs 82 are passed through apertures 94 and 114 and wing nuts 90 are secured thereon. This also serves as a way of storing front legs 82 when easel 10 is in this free standing configuration with upper stand 12 attached to lower base 14.

In this free standing configuration of easel 10, it should be appreciated that base legs 16*b* are extending at an angle to vertical, such as to the right of vertical as shown in FIG. 1. Thus, when upper stand 12 is attached to lower base 14, back legs 84 also assume this same inclination to vertical. This inclination of back legs 84 is desirable as it makes it easy to position frame 52 to be inclined on either side of vertical as desired. In particular, as shown in FIG. 1, frame 52 (which is viewed from the back) is actually inclined so that front 56 actually faces downwards somewhat (i.e., the opposite of FIG. 4 where front 56 faces upwards). When easel 10 is used in this free standing configuration, it has been found that it is easier to paint on canvas 70 when it faces downwards somewhat as shown. This orientation is easily achieved by simply loosening wing nut assembly 104 when upper stand 12 is attached to lower base 14. If it were not for this inclination of back legs 84, it will be appreciated that it would also be necessary to bring slotted braces 102 to extend from front 56 of frame 52, which might not be possible if canvas 70 is in the way. However, if a particularly large inclination of frame 52 were desired and canvas 70 is not in the way, the reversing of the direction which slotted braces 102 extend could be made to position frame 52 as desired.

While the present invention has been described with respect to an exemplary embodiment thereof, it will be understood by those of ordinary skill in the art that variations and modifications can be effected within the scope and spirit of the invention.

I claim:

1. An adjustable artist's easel for holding a canvas comprising:

an upper stand including a canvas holding means for holding a canvas thereto and a standing means for holding a remainder of said upper stand in an upright position on a surface said standing means including at least one leg;

a free standing lower base including at least three base legs with each said base leg having a foot and a base leg mounting means for pivotally mounting said base legs to one another such that said base legs are movable between a collapsed position where said base legs are nearly coplanar and a supporting position where said feet of said base legs are spread apart and said lower base is supported in a standing position; and an attaching means for removably attaching said at least one leg of said upper stand to at least one of said base legs of said lower base such that said upper stand is mounted above said lower base.

2. An adjustable artist's easel as claimed in claim 1 wherein said upper stand further includes a canvas adjusting means for adjusting the canvas so that the canvas faces downwards when said upper stand is attached to said lower base.

3. An adjustable artist's easel as claimed in claim 1 wherein said canvas holding means of said upper stand includes (a) a planar frame having opposed sides, a front, a back, a top, and a bottom, (b) a canvas support on said front of said frame, (c) a top clamp, and (d) a clamp adjusting means for adjustably mounting said top clamp on said front of said frame for movement toward and away from said canvas support and for locking said top clamp in an adjusted position relative to said canvas support with the canvas clamped therebetween and on said front; and wherein said standing means of said upper stand includes (a) said at least one leg comprises a back leg having a free end, (b) a back leg means for pivotally mounting said at least one back leg to said frame, and (c) a back leg locking means for adjustably locking said at least one back leg with said free end spaced from said planar frame such that said upper stand is capable of standing in an upright position.

4. An adjustable artist's easel as claimed in claim 3 wherein said frame is rectangular and includes parallel said sides; and wherein said clamp adjusting means includes a central bar extending in-between said sides and a means for adjustably locking said top clamp to said central bar.

5. An adjustable artist's easel as claimed in claim 1 wherein there are four of said base legs which are attached together in pairs, and wherein said base leg mounting means mounts one pair of said base legs to the other said pair of base legs; and further including a brace means for holding said pairs of base legs in a position with said feet spaced from one another.

6. An adjustable artist's easel as claimed in claim 5 and further including a mounting bracket on each said base leg and a shelf which is supported on said mounting brackets between said base legs.

7. An adjustable artist's easel as claimed in claim 5 wherein each said base leg includes an upper bar, an extension including said foot at one end and whose other end is telescopically received in said upper bar, and an adjustment means for locking the other end of said extension to the associated said upper bar at a plurality of positions.

8. An adjustable artist's easel as claimed in claim 7 wherein said frame of said upper stand is rectangular and includes parallel said sides; and wherein said at lest one upper stand leg includes two back legs, each said back leg being pivotally attached to a respective said side of said frame by a respective said back leg pivot means.

9. An adjustable artist's easel as claimed in claim 8 wherein said attaching means includes (a) studs provided on one of said free ends of said back legs and a pair of said base legs of said lower base and (b) respective sockets provided in the other of said free ends of said back legs and the pair of said base legs of said lower base in which an associated said stud is received.

10. An adjustable artist's easel as claimed in claim 8 wherein said standing means of said upper stand includes two front legs attached to said bottom of said frame; wherein said parallel sides include respective hollow ends; and wherein said back legs include respective removable extensions which are used to support said upper stand in the upright position together with said front legs and which are received in said hollow ends of said parallel sides when said upper stand is attached to said lower base.

11. An adjustable artist's easel as claimed in claim 10 wherein said bottom of said frame includes spaced bottom apertures; wherein said two front legs each include a front leg coupling means for removably attaching said front leg to a respective said bottom aperture; wherein said attaching means includes (a) studs provided on one of said free ends of said back legs and a pair of said base legs of said lower base and (b) respective sockets provided in the other of said free ends of said back legs and the pair of said base legs of said lower base in which an associated said stud is received, and (c) locking apertures in said studs and said sockets which align when said studs are received in associated said sockets such that said front leg coupling means is received in said locking apertures when said upper stand is mounted to said lower base to lock said upper stand to said lower base.

12. An adjustable artist's easel as claimed in claim 3 wherein said attaching means includes (a) a stud provided on one of said free end of said back leg and a top of said lower base and (b) a socket provided in the other of said free end of said back leg and the top of said lower base in which said stud is received.

13. An adjustable artist's easel as claimed in claim 3 wherein said attaching means attaches said upper stand to said lower base with said at least one back leg extending at an angle to vertical, and wherein said back leg pivot means pivotally attaches said at least one back leg to said frame for movement of said frame between positions on each side of vertical when said upper stand is attached to said lower base.

14. An adjustable artist's easel as claimed in claim 3 wherein said top of said frame includes a mounting aperture; and further including a light fixture having a mounting rod which is removably received in said mounting aperture of said frame.

15. An adjustable artist's easel for holding a canvas comprising:

a short upper stand having a planar frame having opposed sides, a front, a back, a top, and a bottom;

a canvas support on said front;

a top clamp;

a clamp adjusting means for adjustably mounting said top clamp on said front for movement toward and away from said canvas support and for locking said top clamp in an adjusted position relative to said canvas support with the canvas clamped therebetween and on said front;

at lest one back leg having a free end;

a back leg pivot means for pivotally mounting said at least one back leg to said frame; and a back leg locking means for adjustably locking said at least one back leg with said free end spaced in back of said planar frame such that said frame is capable of standing in an upright position;

a free standing lower base having at least three base legs with each said base leg having a foot; and a base leg mounting means for pivotally mounting said base legs to one another such that said base legs are movable between a collapsed position where said base legs are nearly coplanar and a supporting position where said feet of said base legs are spread apart and said lower base is supported in a standing position; and an attaching means for removably attaching said back leg of said upper stand to said lower base such that said at least one back leg extends at an angle to vertical, and wherein said back leg pivot means pivotally attaches said at least one back leg to said frame for movement of said frame between positions on each side of vertical when said upper stand is attached to said lower base.

16. An adjustable artist's easel as claimed in claim 15 and further including at least one front leg and a front leg coupling means for removably attaching said front leg to said bottom of said frame.

17. An adjustable artist's easel as claimed in claim 16 and further including an extension for said at least one back leg.

18. An adjustable artist's easel as claimed in claim 17 wherein said frame is rectangular and includes parallel said sides; and wherein said clamp adjusting means includes a central bar extending in-between said sides and a means for adjustably locking said top clamp to said central bar.

19. An adjustable artist's easel as claimed in claim 18 wherein said upper stand includes two of said back legs, each said back leg being pivotally attached to a respective said side of said frame by a respective said back leg pivot means.

20. An adjustable artist's easel as claimed in claim 19 wherein said upper stand includes two front legs attached to said bottom of said frame; wherein said parallel sides include respective hollow ends; and wherein said back legs include respective removable extensions which are used to support said upper stand in the upright position together with said front legs and which are stored in said hollow ends of said parallel sides.

21. An adjustable artist's easel as claimed in claim 15 wherein said top of said frame includes a mounting aperture; and further including a light fixture having a mounting rod which is removably received in said mounting aperture of said frame.

22. An adjustable artist's easel as claimed in claim 15 wherein said frame is rectangular and includes parallel said sides; and wherein said camp adjusting means includes a central bar extending in-between said sides and a means for adjustably locking said top clamp to said central bar.

23. An adjustable artist's easel as claimed in claim 15 wherein there are four of said base legs which are attached together in pairs, and wherein said base leg mounting means mounts one pair of said base legs to the other said pair of base legs; and further including a brace means for holding said pairs of base legs in a position with said feet spaced from one another.

24. An adjustable artist's easel as claimed in claim 23 and further including a mounting bracket on each said base leg and a shelf which is supported on said mounting brackets between said base legs.

25. An adjustable artist's easel as claimed in claim 23 wherein each said base leg includes an upper bar, an extension including said foot at one end and whose other end is telescopically received in said upper bar, and an adjustment means for locking the other end of said extension to the associated said upper bar at a plurality of positions.

26. An adjustable artist's easel as claimed in claim 25 wherein said frame is rectangular and includes parallel said sides; and wherein said upper stand includes two of said back legs, each said back leg being pivotally attached to a respective said side of said frame by a respective said back leg pivot means.

27. An adjustable artist's easel as claimed in claim 26 wherein said attaching means includes (a) studs provided on one of said free ends of said back legs and a pair of said base legs of sad lower base and (b) respective sockets provided in the other of said free ends of said back legs and the pair of said base legs of said lower base in which an associated said stud is received.

28. An adjustable artist's easel as claimed in claim 26 wherein said upper stand includes two front legs attached to said bottom of said frame; wherein said parallel sides include respective hollow ends; and wherein said back legs include respective removably extensions which are used to support said upper stand in the upright position together with said front legs and which are received in said hollow ends of said parallel sides when said upper stand is attached to said lower base.

29. An adjustable artist's easel as claimed in claim 28 wherein said bottom of said frame includes spaced bottom apertures; wherein said two front legs each include a front leg coupling means for removably attaching said front leg to a respective said bottom aperture; wherein said attaching means includes (a) studs provided on one of said free ends of said back legs and a pair of said base legs of said lower base and (b) respective sockets provided int eh other of said free ends of said back legs and the pair of said base legs of said lower base in which an associated said stud is received, and (c) locking apertures in said studs and sad sockets which align when said studs are received in associated said socket such that said front leg coupling means is received in said locking apertures when said upper stand is mounted to said lower base to lock said upper stand to said lower base.

30. An adjustable artist's easel as claimed in claim 15 wherein said attaching means includes (a) a stud provided on one of said free end of said back leg and a top of said lower base and (b) a socket provided in the other of said free end of said back leg and the top of said lower base in which said stud is received.

31. An adjustable artist's easel for holding a canvas comprising:

a short upper stand having a planar rectangular frame having two vertical sides with respective hollow ends, a front, a back, a top, and a bottom;

a canvas support on said front;

a top clamp a clamp adjusting means for adjustably mounting said top clamp on said front for movement toward and away form said canvas support and for locking said top clamp in an adjusted position relative to said canvas support with the canvas clamped therebetween and on said front;

two front legs;

a front leg coupling means for removably attaching said front legs to said bottom of said frame two back legs, each having a free end and a removable extension for said back leg such that said removable extensions are used to support said upper stand in the upright position together with said front legs and said extension are stored in a respective said hollow end of said vertical sides;

a back leg pivot means for pivotally mounting said back legs to a respective said vertical side of said frame;

a back leg locking means for adjustably locking said back legs with said free end spaced in back of said planar frame such that said frame is capable of standing in an upright position.

* * * * *